United States Patent [19]

Mumma

[11] 3,948,023

[45] Apr. 6, 1976

[54] EGG CARTON CONVEYOR

[75] Inventor: Harold J. Mumma, Riverside, Calif.

[73] Assignee: FMC Corporation, San Jose, Calif.

[22] Filed: Aug. 5, 1974

[21] Appl. No.: 495,687

[52] U.S. Cl. ..... 53/160; 198/198

[51] Int. Cl.[2] ..... B65B 35/30; B65G 15/42

[58] Field of Search ..... 53/160, 376, 300, 329; 198/131, 198

[56] References Cited

UNITED STATES PATENTS

| | | | |
|---|---|---|---|
| 1,681,301 | 8/1928 | Maggi | 198/131 X |
| 2,776,528 | 1/1957 | Niederer et al. | 198/131 X |
| 3,668,048 | 6/1972 | Noguchi et al. | 53/376 X |
| 3,722,173 | 3/1973 | Noguchi | 53/166 X |

*Primary Examiner*—Travis S. McGehee

*Attorney, Agent, or Firm*—R. S. Kelly; J. W. Edwards; C. E. Tripp

[57] ABSTRACT

A conveyor advances an egg carton to an egg receiving station located beneath an egg delivery conveyor which is arranged to individually drop eggs into the carton pockets until one row of pockets in the carton is filled. The conveyor then indexes the carton forward, allowing the succeeding row or a succeeding carton to be filled in a similar manner. The conveyor is arranged to carry cartons made of thin plastic material, such material being very flexible and resilient and requiring special support upon the conveyor in order to absorb the shock of an egg dropped into a carton pocket. The conveyor includes a plurality of spaced carriers with each carrier supporting one egg carton and with each carrier including a plurality of support posts projecting upwardly from the body of the carrier for supporting the carton so that each egg pocket in the carton is suspended above the carrier by a distance that exceeds the downward deflection of the pocket when an egg is dropped therein. The support posts are arranged so that each egg pocket is supported on each side thereof, and the support posts further provide lateral support for the carton thereby limiting the horizontal movement of the carton. A plurality of straps overlying the carrier between the support posts extend longitudinally of the conveyor and serve to support the trailing cover portion of an unloaded egg carton in order to prevent overturning of the carton on the support posts.

8 Claims, 9 Drawing Figures

EGG CARTON CONVEYOR

BACKGROUND OF THE INVENTION

1. Field of the Invention

This invention pertains to conveyors, and more particularly, it relates to a conveyor for advancing empty egg cartons made of thin flexible material past a station where eggs are discharged vertically into the cartons.

2. Background of the Invention

Conveyors for advancing empty egg cartons by a station where eggs are dropped into the cartons qre well known in the egg handling field. A typical form of such a conveyor is disclosed in prior U.S. Pat. No. 3,447,282, issued to Harold J Mumma on June 3, 1969, which patent discloses an endless chain conveyor structure including a plurality of upright pusher members spaced along the chain for individually engaging egg cartons and sliding the cartons between a pair of longitudinally extending bars or rails. Cartons normally handled by such a conveyor are made of paper mache, plastic or cardboard and have sufficient stiffness to support the eggs while spanning transversely between spaced supporting surfaces. Such cartons also have an inherent resiliency that enables the egg receiving pockets to yield internally and thereby cushion or absorb the shock of an egg as it is received in a pocket.

A form of egg carton currently used in Japan and contemplated for use in other areas of the world is made of polyvinylchloride having a thickness of about 0.005 inches. The carton is transparent to allow the eggs to be viewed within a closed carton, and the carton is very light and flexible. There are two rows of pockets in the carton with five pockets in each row. When the pockets of such cartons are resting upon a support surface, there is not sufficient internal yielding of the pocket to absorb the shock of an egg dropped therein, and the shock reaction resulting from the falling egg striking the carton pocket can break the egg. Such cartons also do not have sufficient stiffness to serve as a beam to support eggs while spanning a distance that is a significant portion of the length of the carton, nor do they have sufficient mass to provide stability against overturning if eccentrically loaded with eggs and subjected to deceleration forces or if unloaded and subjected to gusts of wind or acceleration forces. Thus, the egg carton conveyor disclosed in the previously mentioned U.S. Pat. No. 3,447,282 does not satisfactorily handle thin plastic cartons, such as those currently used in Japan. Other prior art carton conveyors suffer similar defects and have not proven to be effective in handling the aforementioned thin, flimsy cartons.

SUMMARY OF THE INVENTION

The purpose of the present invention is to provide a conveyor for moving egg cartons made of thin flexible material by an egg discharge station where eggs are discharged vertically into pockets within the cartons without damage to the eggs or to the cartons.

An egg carton conveyor is comprised of a plurality of spaced carriers mounted for movement past the egg discharge station with each carrier being arranged to support an egg carton of the aforementioned thin and flimsy type. A support, projecting upwardly from the carrier, is arranged to support the egg carton so that each egg pocket in the carton is suspended above the carrier or other horizontal support surface by a distance that exceeds the downward deflection of the pocket when an egg is dropped therein. In the preferred form of the invention a plurality of supports are provided to insure positive support for both transversely extending sides of the rows of egg pockets in the egg cartons, and each support comprises a plurality of transversely spaced, upright support posts which are arranged to be received in underlying recesses in the egg carton between each adjacent pair of egg-receiving pockets.

DESCRIPTION OF THE PREFERRED EMBODIMENT

Figure 1:
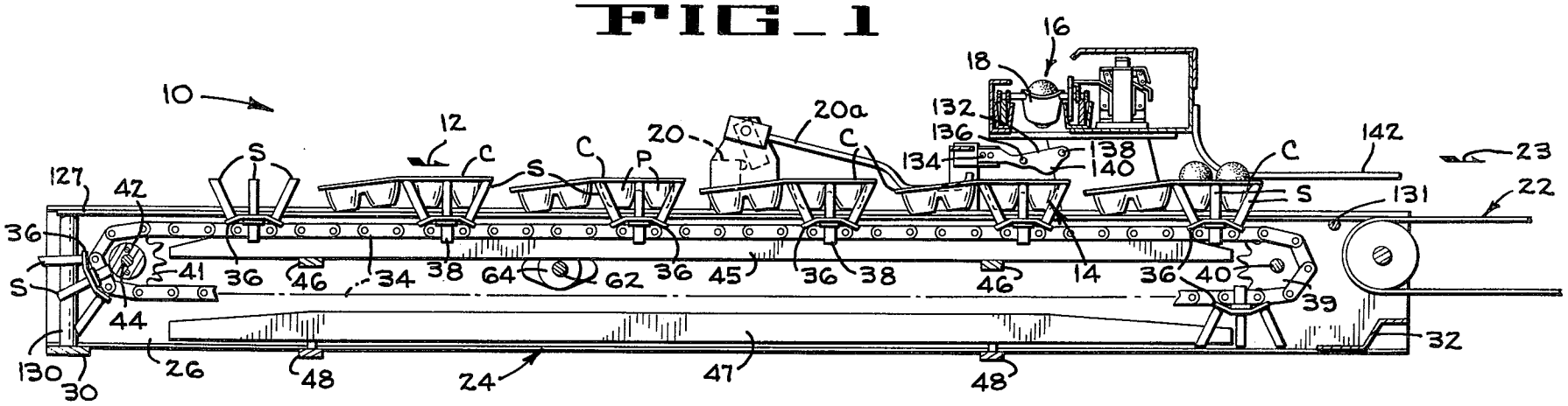
FIG. 1 is a side elevation, partly broken away and partly in section, of an egg carton conveyor embodying the present invention.

With reference to FIG. 1, an egg carton conveyor 10 constructed in accordance with the concepts of the present invention is arranged to receive cartons C one-by-one from a dispenser, not shown, and intermittently advance the cartons in single file from left to right, as indicated by the directional arrow 12. Eventually, each row of carton pockets P, which extend transversely of the egg carton conveyor, is stopped at an egg receiving station 14 located under an egg-delivery conveyor 16 having a series of egg carrier buckets 18 disposed in single file and extending perpendicularly to the direction of movement of the carton conveyor 10. The egg-delivery conveyor is part of an egg grading machine, such as that disclosed in prior U.S. Pat. No. 2,895,274, issued to Harold J Mumma on July 21, 1959. Within such an egg grading machine, eggs are inspected, weighed and transferred to the egg-delivery conveyor 16 for subsequent selective packing in cartons such as egg cartons C. It will be understood that a combination of several egg carton conveyors 10 can be arranged side-by-side so that the cartons C on each egg carton conveyor can receive eggs from the same egg-delivery conveyor 16. The discharge of eggs from the egg-delivery conveyor is under control of a memory system in the egg grading machine. Eggs of different weight, or grade, can be delivered to cartons on different egg carton conveyors. A no-carton no-fill switch 20 is provided with a pivotally mounted actuating arm 20*a* which extends over the carton conveyor so as to be engaged by the upper edges of the egg cartons in order to prevent the dropping of eggs when no carton is in receiving position under the egg-delivery conveyor.

Eggs are dropped one-by-one into the pockets of one row of pockets of the carton C, starting at the downstream end of the row, as the egg-delivery conveyor 16 moves over the row. When all the pockets in the row have been filled, the egg carton conveyor 10 quickly indexes the carton to bring the next row of pockets into position under the egg-delivery conveyor, and the pocket filling procedure is repeated. When all of the carton pockets have been filled, the egg carton conveyor quickly indexes to bring the first row of pockets in the next carton into position under the egg-delivery conveyor and to advance the filled carton towards a carton discharge conveyor 22 moving in the direction of arrow 23.

The egg carton conveyor 10 has a frame structure 24 (FIGS. 1 and 2) that includes a left side frame member 26 and a right side frame member 28 held in spaced relationship by transverse braces 30 and 32 at the longitudinal ends of the frame structure. The conveyor frame structure can be mounted upon the framework of the main egg grading machine, or it can be supported upon legs in a conventional manner.

Figure 6:
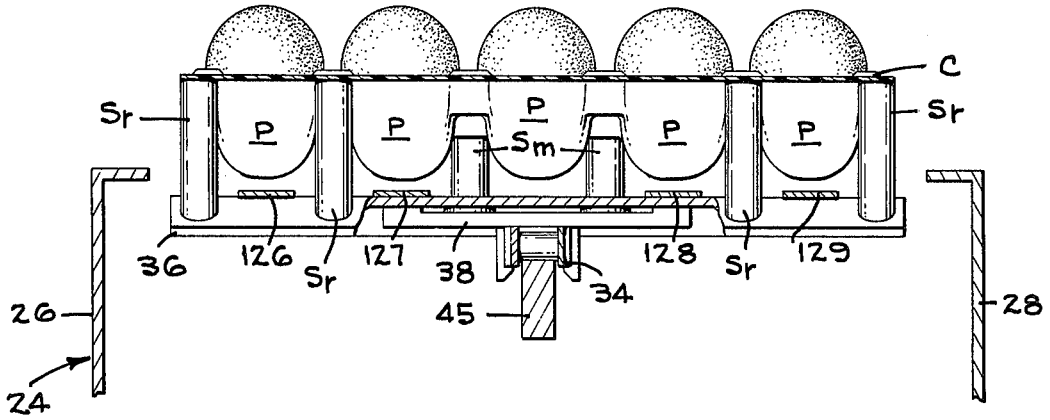
FIG. 6 is an enlarged broken section taken on the line 6—6 of FIG. 2.
Figure 8:
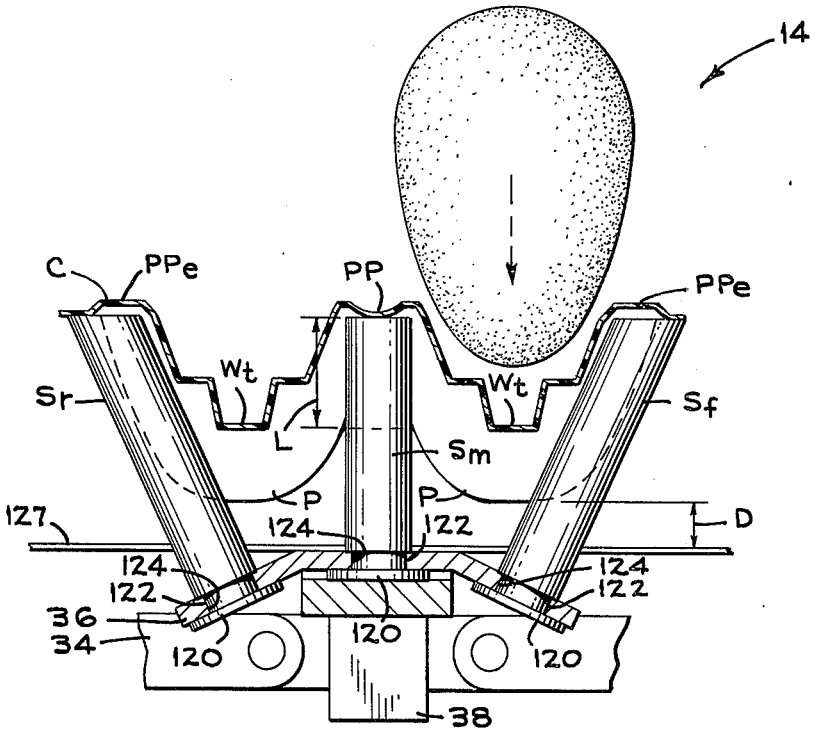
FIGS. 8 and 9 are operational views illustrating the dropping of an egg into a carton pocket and the carton deformation which absorbs the impack thereof.
Figure 9:
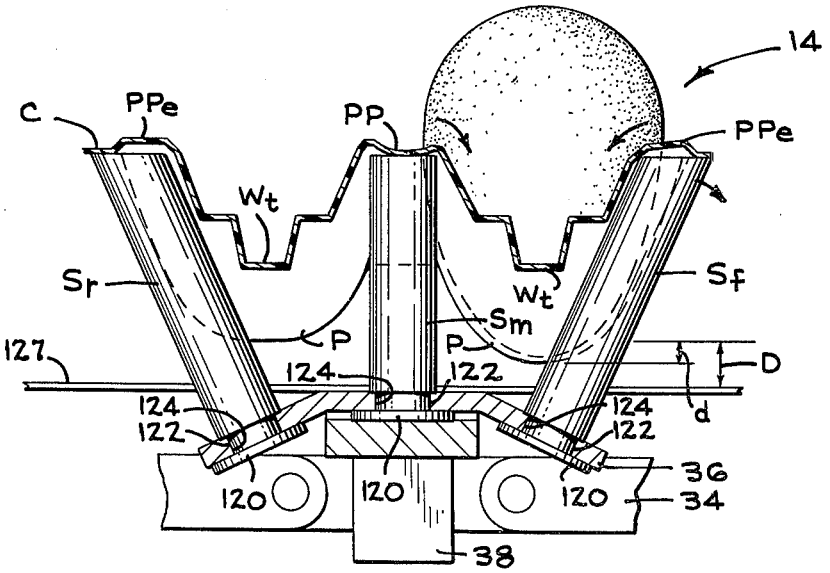

The egg carton conveyor 10 includes an endless chain 34 which has a plurality of carrier members 36 secured thereto by attachment brackets 38 (FIGS. 6, 8 and 9). One end of the chain is trained about a sprocket 39 that is rotatably mounted on a threaded shaft 40 extending between the side frame members 26 and 28, and the other end of the chain is trained about a sprocket 41 that is coupled through a spacer 42 (FIGS. 1 and 3) to a driven journal 43 (FIG. 3) which is setscrewed to a drive shaft 44 extending between the side frame members 26 and 28. The upper run of the endless chain is supported longitudinally by a track 45 FIG. 1) mounted upon supports 46 extending transversely between side frame members 26 and 28, while the lower run of the chain is supported longitudinally by a track 47 mounted upon transverse supports 48 that extend between the side frame members. One end of drive shaft 44 is rotatably journalled in a bearing unit 50 (FIG. 3) mounted to side frame member 26, and the other end of the shaft is journalled for rotation in a bearing unit 52 carried by side frame member 28.

Drive shaft 44 is arranged to be driven through a clutch unit 54 (FIG. 3), which will subsequently be described, of the general type disclosed in prior U.S. Pat. No. 3,112,023, issued to Harold J Mumma on Nov. 26, 1963. The clutch 54 is normally maintained in a disengaged position so that the egg carton conveyor 10 remains at rest, and it is adapted to be briefly engaged whenever it is necessary to advance the conveyor for moving an empty row of carton pockets P to the egg receiving station 14. A driven sprocket wheel 56 is fastened to the clutch and a drive chain 58 is trained about the sprocket wheel. The drive chain connects the sprocket wheel 56 with a drive sprocket 60 (FIG. 2) that is mounted on a shaft 62 journalled in suitable bearing units 64 and 66 that are carried by the left and right side frame members 26 and 28, respectively. The shaft 62 is arranged to be continuously driven by a sprocket 68 which may, in turn, be driven by a chain 70 connected to any suitable source of power, as for example, an electric motor, or a drive mechanism of the main egg grading machine.

Figure 3:
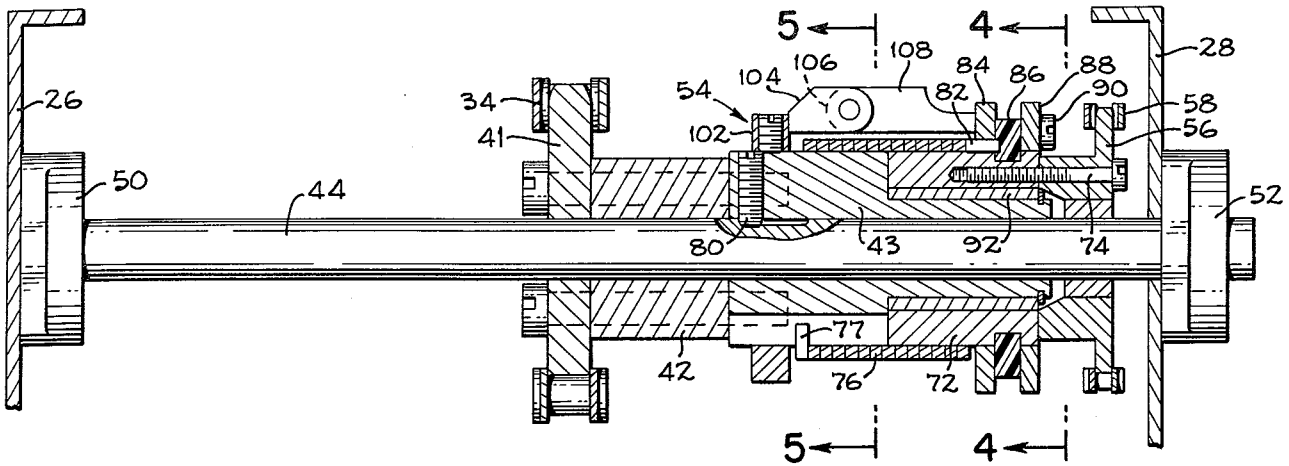
FIG. 3 is an enlarged vertical section taken along the line 3—3 of FIG. 2.

The clutch 54, shown in detail in FIG. 3, includes a rotating sleeve 72 that is connected by cap screws 74 with the driven sprocket wheel 56. The sleeve is rotated as shown by the directional arrow 78 in FIG. 5 and is encircled by a coil spring 76 which has a trailing end 77 secured to the driven journal 43. As mentioned hereinbefore, this journal 43 is secured by a setscrew 80 to the drive shaft 44. A leading end 82 of the coil spring 76 is secured to a stop ring 84 that is connected with a nylon ring 86 and a ratchet plate 88 by a capscrew 90. The nylon ring supports the ratchet plate and stop ring for rotation upon the rotating sleeve 72, and a bushing 92 interposed between the interior of the rotating sleeve and the driven journal 43 enables rotation therebetween.

Normally, the ratchet plate 88 is prevented from rotating by means of a latching pawl 94 (FIG. 4) that is pivotally mounted upon a stud shaft 96 which projects inwardly from the right side frame member 28. The nose 98 of the pawl is forced into engagement with one of the teeth of the ratchet plate by means of a compression spring 100. As long as the leading end 82 of the coil spring 76 surrounding the rotating sleeve 72 is positively restrained from movement in the direction of rotation of the sleeve by its connection with the ratchet plate 88, an unwinding force will be imparted to the spring increasing its diameter so that it loses contact with the rotating sleeve. Thus, the rotating sleeve idles within the coil spring, and the drive shaft 44 does not rotate.

When the pawl 94 is disengaged from the ratchet plate 88, the frictional engagement of the rings 84 and 86 and ratchet plate 88 with the rotating sleeve 72 applies a winding force to the coil spring 76 which rapidly contracts to its normal diameter and applies a gripping force on the rotating sleeve 72 to force the driven journal 43 and drive shaft 44 to rotate therewith. When rotation of the ratchet plate is blocked by reengagement of the pawl nose 98 with the next subsequent ratchet tooth, the spring is again subjected to an unwinding stress which interrupts the driving connection between the rotating sleeve and the driven journal to stop the egg carton conveyor 10.

Figure 5:
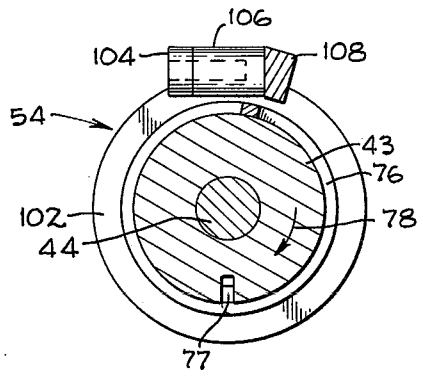
FIG. 5 is a section taken on the line 5—5 of FIG. 3.

To prevent the endless chain 34 from being advanced too far by its own momentum and that of its drive means when rotation of ratchet plate 88 is arrested by the pawl 94, an adjustment ring 102, setscrewed to the driven journal 43, is provided with a laterally projecting arm 104 that supports a stop cushion 106 bolted perpendicularly thereto (FIGS. 3 and 5). The stop cushion is arranged to strike a flange 108 that projects laterally from the stop ring 84. Adjustment of the stop cushion can be made by loosening the adjusting ring and setting the stop cushion against the flange 108 when the ratchet plate is in the proper position to set the correct amount of torsion force in the spring 76. The setscrew that locks the adjusting ring to the driven journal is then tightened.

Disengagement of the pawl 94 from the ratchet plate 88 to advance the egg carton conveyor 10 is effected by means of a solenoid 110 (FIG. 4) that is mounted by a bracket (not shown) extending from right side frame member 28. The normally projected armature of the solenoid is connected through a link 112 to the free end of the pawl. Thus, when the solenoid is energized by a short duration pulse to retract the link, the pawl is pivoted to swing the nose 98 thereof out of the path of the ratchet plate teeth. This causes engagement of the clutch 54 in the manner previously described.

Figure 4:
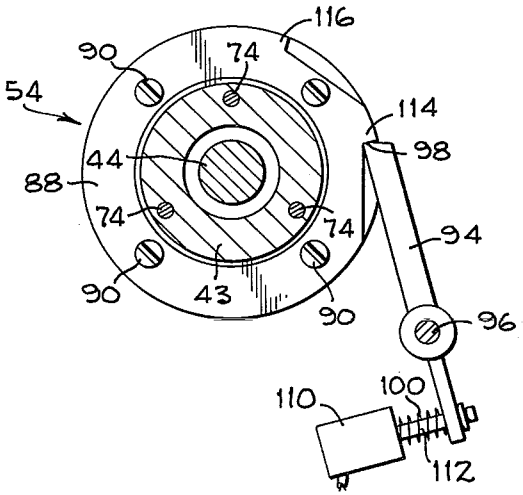
FIG. 4 is a section taken on the line 4—4 of FIG. 3.

Since each carton C has two rows of pockets P to be filled, as illustrated in FIG. 1, the egg carton conveyor 10 is arranged to advance first through the relatively short distance that is necessary to place a directly succeeding row of pockets of an egg carton into egg receiving position below the egg-delivery conveyor 16. When the second row of pockets of the particular carton has been filled with eggs, the egg carton conveyor is advanced a longer distance appropriate to place the first row of pockets of the next succeeding carton into egg receiving position beneath the egg-delivery conveyor. Accordingly, as shown in FIG. 4, the peripheral edge of the ratchet plate 88 is provided with one tooth 114 and a second tooth 116 with the circumferential spacing from tooth 116 to tooth 114 in the direction of rotation of the ratchet plate being relatively small, corresponding to the short conveyor advancement necessary to place a directly succeeding row of pockets into egg receiving position, and the circumferential spacing from tooth 114 to tooth 116 in the direction of rotation of the ratchet plate being relatively large and corresponding to the conveyor advancement necessary to place the first row of pockets of the next succeeding carton into egg receiving position beneath the egg-delivery conveyor.

Energization of the solenoid 110 with a short duration pulse upon the filling of a row of pockets with eggs is provided either by a manually operated switch (not shown) or by a memory system in the main egg grading machine (not shown) that governs the release of eggs from the egg delivery conveyor 16 as well as the advancement of the egg carton conveyor 10.

Projecting upwardly from each carrier member 36 are three parallel rows of supports which extend transversely of the conveyor 10 for supporting an egg carton C above the level of the carrier member (see FIG. 6). Each row of supports is comprised of six uniformly spaced support posts S. Support posts $S_m$ in the middle row project upwardly vertically from the carrier member. Support posts $S_f$ in the front row are inclined to project forwardly in the direction of movement of the carrier member as well as upwardly of the carrier member, and support posts $S_r$ in the rear row are inclined to project upwardly and rearwardly of the carrier member. The support posts are made of rubber-like material that permits a slight amount of resilient deflection. Each support post has an enlarged head portion 120 (FIGS. 8 and 9) and a retaining groove 122 adjacent the head portion. The head portion of each support post is adapted to be forced through a hole 124 in the carrier plate and thereby locked in place when the retaining groove is aligned with the hole. Since the front and rear portions of the carrier member are downwardly inclined from the mid-portion thereof, the support posts $S_f$ project forwardly of the carrier member and the support posts $S_r$ project rearwardly of the carrier member with respect to the direction of movement of the carrier member.

Figure 2:
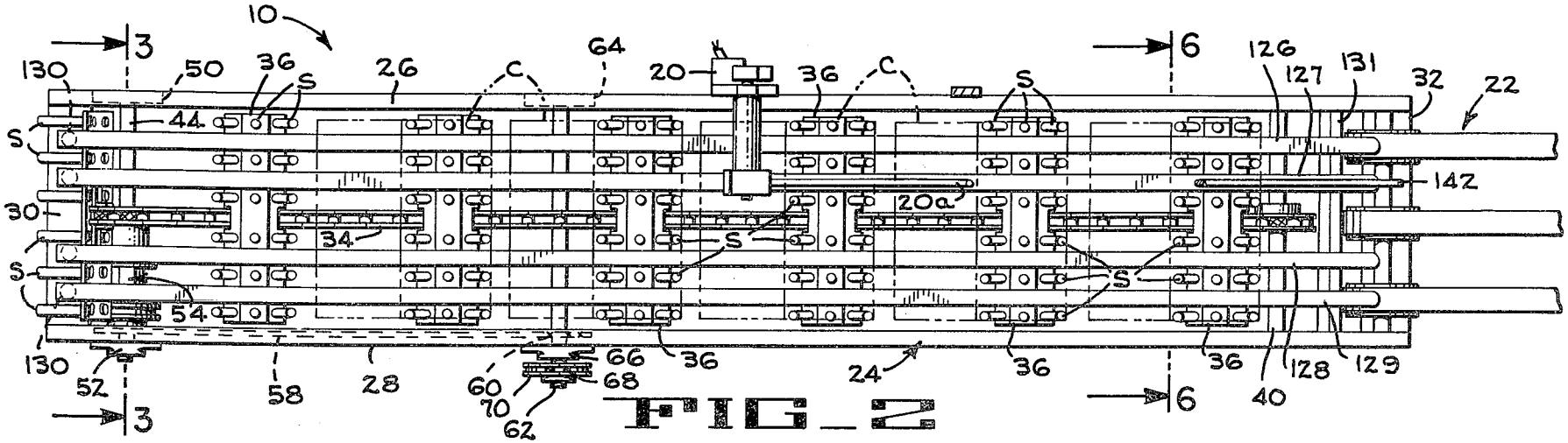
FIG. 2 is a plan of the conveyor shown in FIG. 1.

Extending longitudinally of the egg carton conveyor 10 and positioned above the carrier members are rigid metallic straps 126, 127, 128 and 129 (FIG. 2) which support the covers of the cartons C as will subsequently be explained. The straps are fixed in position and allow the carrier members to slide freely thereunder. These straps fit between the support posts S and are spaced outwardly from the endless chain 34, as shown in FIG. 2. The straps are mounted at one end upon posts 130 (FIG. 1) which extend in upright positions from the transverse brace 30, while the opposite ends of the straps extend to the carton discharge conveyor 22 and are arranged to be received upon a transversely extending rod 131.

Figure 7:
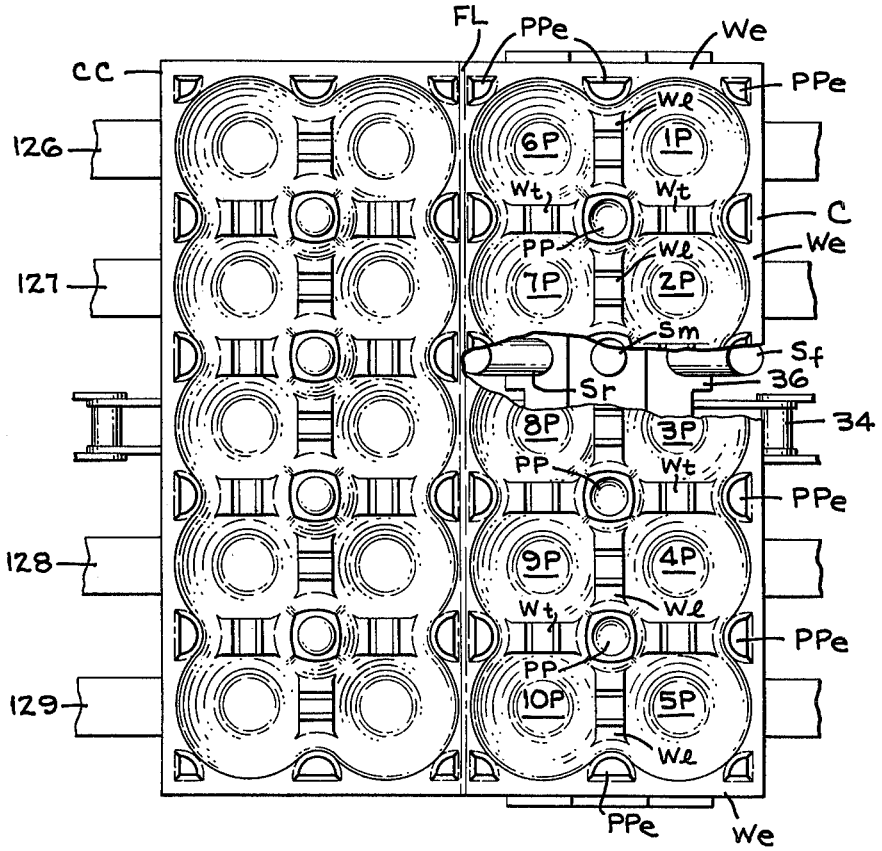
FIG. 7 is a broken plan of an egg carton that is being advanced on the carton conveyor of the present invention.

A typical carton C of the type to be handled by the egg carton conveyor 10 is shown in plan in FIG. 7. This cartoon is made of flexible transparent plastic material, such as polyvinylchloride, with a thickness of about 0.005 inches. The carton has a first row of five pockets 1P-5P and a second row of five pockets 6P-10P. Upstanding webs $W_1$ and $W_t$ between the pockets form a grid of longitudinal and transverse stiffeners, and hollow post portions PP are formed at the intersections of the longitudinal and transverse stiffeners and extend upwardly therefrom. Upstanding webs $W_e$ at the ends and side edges of the carton form partial post portions $PP_e$ about the perimeter of the carton at their intersections with each other and their intersections with the longitudinal and transverse stiffener webs $W_1$ and $W_t$. A carton cover CC of generally matching configuration is connected to the trailing edge of the carton along a fold line FL.

The carton C rests upon the support posts S with each support post fitting into a hollow recess beneath a post portion PP or a partial post portion $PP_e$ (FIGS. 8 and 9). The height of the support posts is sufficient to hold the carton at a level whereby each pocket P is suspended above the carrier member 36 and above the straps 126, 127, 128, and 129 by a distance D, as shown in FIG. 8, that exceeds the maximum downward deflection d of the carton when an egg is dropped into the pocket, as shown in FIG. 9. The shock of an egg dropping into a carton pocket P is absorbed by resilient deflection of the thin flexible carton, the pocket of which deflects downwardly and spreads outwardly upon receiving an egg. The shock is also absorbed to a slight extent by deflection of the support posts $S_r$ and $S_f$. The post portions PP and partial post portions $PP_e$ of the carton can slide inwardly slightly upon the top of the support posts in directions toward the loaded pocket (as shown by the arrows in FIG. 9), and the inclined support posts $S_f$ and $S_r$ can deflect slightly in an outwardly and downwardly direction.

As shown in FIG. 8, the upwardly projecting support posts $S_m$, $S_f$ and $S_r$ lap vertically by a distance L with the hollow portions or underlying recesses of the carton projecting downwardly from the tops of the post portions PP and partial post portions $PP_e$. This vertical lapping of the support posts and carton recesses limits horizontal movement of the carton upon the support posts so that the carton does not slide off the support posts. The distance L is sufficient to provide good lateral support for the carton even though one end of the carton may be in an uplifted position resulting from bounce or unequal loading following the dropping of an egg into a carton pocket P. Such limiting of horizontal movement is also essential when the carton is contacted by the actuating arm 20*a* of the no-carton no-fill switch 20 or by the cam surfaces of the arrestor blades, which will subsequently be described.

To reduce the horizontal momentum of the eggs as they drop from the egg-delivery conveyor 16 and thus prevent breakage caused by the transmittal of an excessive impact force from a descending egg to a previously deposited egg in an adjacent pocket of the egg carton C, a series of arrestor blades 132 (only one being shown in FIG. 1) in the form of transversely extending leaf springs are pivotally mounted upon a rod 134 at spaced intervals and extend laterally of the rod in vertical planes at the sides of each of the pockets P in the egg carton. The rod 134 is suitably supported from the machine frame above the upper run of the egg-delivery conveyor. When eggs drop from the egg-delivery conveyor buckets 18, their trajectory carries them against the faces of the arrestor blades which absorb their horizontal momentum and deflect them smoothly into the proper carton pockets. To further guide the eggs released from the buckets 18, a pair of projections 136 and 138 extend in parallel from each side of the arrestor blades 132 for about one-third the distance between arrestor blades. A curved lower portion 140 of each of the arrestor blades 132 is arranged to extend downwardly into the carton notch above the transverse webs $W_t$ between posts PP and $PP_e$ after an egg has been deposited in a carton pocket and the arrestor blade has pivoted downwardly. When the egg carton conveyor 10 is advanced to bring another row of pockets beneath the egg-delivery conveyor, the arrestor blades are pivoted upwardly to the position shown in FIG. 1 when the curved portions 140 thereof contact the post portions PP or $PP_e$ of the carton.

Cartons C filled with eggs are conveyed towards the carton discharge conveyor 22, and, as the carrier member 36 that supports a carton pivots about sprocket 39, the support posts S will move downwardly and the carton will be lowered until the bottom of the pockets rest upon the straps 126-129. The support posts of the moving carrier member continue to slide the carton forwardly on the straps for a short distance until it is received upon the belts of the carton discharge conveyor and carried away to a station where the cover is closed and the filled cartons are packed into larger containers for shipment to the marketplace.

A carton hold-down rod 142 (FIG. 1) extends from the frame of the egg-delivery conveyor 16 over the end portion of the egg carton conveyor 10 to a position above the carton discharge conveyor 22. The hold-down rod prevents a carton that has been loaded unevenly with eggs from overturning when on the straps 126-129.

From the foregoing description, it will be seen that the present invention enables the loading of eggs into cartons made of thin, flexible material without damage to the eggs or to the cartons.

Although the best mode contemplated for carrying out the present invention has been herein shown and described, it will be apparent that modification and variation may be made without departing from whaat is regarded to be the subject matter of the invention.

What is claimed is:

1. In a conveyor for advancing cartons to an egg receiving station where eggs are dropped into pockets of the cartons and for removing filled cartons from the egg receiving station, said conveyor including a carrier, the improvement comprising a plurality of supports projecting upwardly from the carrier and extending transversely of the direction of movement of the conveyor at each transverse side of each row of egg pockets for supporting a carton at a level above the carrier whereby each egg pocket in the carton is suspended above the carrier and any other horizontal support surface beneath the carton at the egg receiving station by a distance that exceeds the downward deflection of the carton when an egg is dropped into the pocket, said supports comprising rows of upstanding support posts that fit within post recesses on the underside of the carton and are spaced transversely of the direction of movement of the conveyor so as to be received between each adjacent pair of egg pockets in said egg carton.

2. A conveyor according to claim 1 wherein said support posts are made of rubber-like material.

3. A conveyor according to claim 2 wherein said support posts are arranged in three parallel rows extending transversely of the carrier, support posts within the middle row projecting upward vertically from the carrier while support posts in the front row are inclined to project forwardly of the carrier and support posts in the rear row are inclined to project rearwardly of the carrier, said inclined support posts deflecting more readily to provide a cushioning effect when an egg is dropped into a pocket of the carton.

4. In a conveyor for moving cartons by a station where eggs are dropped into pockets within the cartons, said conveyor including a carrier, and wherein the improvement comprises a support projecting upwardly from the carrier for supporting a carton so that it is suspended at a level above the carrier and thereby allowed to deflect downwardly when eggs are dropped into said pockets, said support being comprised of a plurality of support posts which project upwardly from the carrier and are arranged to be received within recesses on the underside of the carton, said support posts being provided in three rows spaced longitudinally in the direction of movement of the conveyor so as to support an egg carton having two transversely extending rows of pockets and to support each longitudinal and transverse side of each egg pocket in the carton.

5. In a conveyor for moving cartons by a station where eggs are dropped into pockets within the cartons, said conveyor comprising an endless conveyor and having an upper run including a carrier mounted for movement therewith, the improvement comprising a plurality of support posts projecting upwardly from the carrier for supporting a carton so that it is suspended at a level above the carrier and thereby allowed to deflect downwardly when eggs are dropped into said pockets, said support posts being spaced transversely of said conveyor, and a plurality of straps overlying the carrier between the support posts and extending longitudinally of the conveyor at the discharge end thereof for stripping the cartons from the conveyor as the carrier moves out of said upper run of the conveyor.

6. A carton conveyor for use with an egg grading machine which includes means for discharging eggs vertically downward into the egg-receiving pockets of egg cartons carried by said conveyor, said carton conveyor comprising a plurality of spaced carriers each being arranged to support one of said egg cartons, and means for moving said carton conveyor to successively bring each of said carriers into a position beneath said egg discharging means to receive the eggs discharged therefrom, each of said carriers comprising a plurality of supports extending transversely of the direction of movement of the conveyor, said supports being spaced longitudinally in the direction of movement of the conveyor and being arranged to support each row of eggreceiving pockets in the egg carton on both transversely extending sides thereof, said supports projecting upwardly from the conveyor for a distance such that the egg carton supported thereby is suspended above the conveyor and allowed to deflect downwardly upon the reception of eggs in the pockets thereof.

7. A carton conveyor according to claim 6 wherein said supports are formed of rubber-like material and wherein the trailing and leading supports are inclined with respect to the vertical so that they can deflect downwardly under the impact of the eggs being received in the pockets of the carton supported thereby.

8. A carton conveyor according to claim 6 wherein each of said supports is comprised of a plurality of spaced support posts configured so as to be received in recesses on the underside of the egg carton between each adjacent pair of egg-receiving pockets.

* * * * *